US007862712B2

(12) United States Patent
Tak

(10) Patent No.: US 7,862,712 B2
(45) Date of Patent: Jan. 4, 2011

(54) SWIMMING POOL CLEANING SYSTEM

(76) Inventor: Man Fui Tak, P.O. Box 573, Id Muller Street, South Buccleuch (ZA) 2066

( * ) Notice: Subject to any disclaimer, the term of this patent is extended or adjusted under 35 U.S.C. 154(b) by 0 days.

(21) Appl. No.: 11/911,662

(22) PCT Filed: Apr. 13, 2006

(86) PCT No.: PCT/ZA2006/000055

§ 371 (c)(1),
(2), (4) Date: May 19, 2008

(87) PCT Pub. No.: WO2006/110928

PCT Pub. Date: Oct. 19, 2006

(65) Prior Publication Data

US 2008/0272039 A1 Nov. 6, 2008

(30) Foreign Application Priority Data

Apr. 14, 2005 (ZA) ..... 2004/8293

(51) Int. Cl.
*E04H 4/12* (2006.01)
*E04H 4/16* (2006.01)

(52) U.S. Cl. ..... 210/167.13; 210/167.15; 210/416.2

(58) Field of Classification Search ..... 210/167.1, 210/167.12, 167.13, 167.15, 167.17, 416.1, 210/416.2; 4/507; 15/1.7
See application file for complete search history.

(56) References Cited

U.S. PATENT DOCUMENTS 3,306,448 A * 2/1967 Baker ..... 210/121
3,365,064 A * 1/1968 Horan, Jr. ..... 210/167.13
3,575,729 A * 4/1971 Howard ..... 134/168 R
4,729,406 A 3/1988 Frentzel
4,826,591 A 5/1989 Macia
5,238,585 A * 8/1993 Reed, Sr. ..... 210/805
5,490,923 A 2/1996 Penney
5,753,112 A * 5/1998 Barnes ..... 210/167.12
5,785,846 A * 7/1998 Barnes et al. ..... 210/167.12
6,022,481 A * 2/2000 Blake ..... 210/776
6,419,840 B1 * 7/2002 Meincke ..... 210/767
6,473,928 B1 * 11/2002 Veloskey et al. ..... 15/1.7

FOREIGN PATENT DOCUMENTS

EP 0357810 3/1990
WO 9851888 11/1998

OTHER PUBLICATIONS

International Search Report (PCT/ZA2006/000055), dated Jul. 8, 2006, 5 pages.

* cited by examiner

*Primary Examiner*—Fred Prince
(74) *Attorney, Agent, or Firm*—Banner & Witcoff, Ltd

(57) ABSTRACT

A pool cleaning installation that circulates water of a pool filtering and cleaning the water, having a suction connection to a flexible hose of a suction type automated pool cleaner and a return to a Venturi (10) located in the weir (5) of the pool which has a return pipe (11) to the pool, so that the Venturi action draws water into the weir to skim debris off the pool surface to collect in a leaf basket. The operation of the automated pool cleaner on the pool bottom and walls is not affected should the surface debris clog the leaf basket in the weir.

17 Claims, 2 Drawing Sheets

5
17
20
21
18
10
11
16

5
20
16
19
21

SWIMMING POOL CLEANING SYSTEM

FIELD OF THE INVENTION

This invention lies in the field of swimming pool cleaning devices and in swimming pool cleaning in general.

BACKGROUND

Swimming pool cleaning has received much attention in the last few decades and automated pool cleaners are well established, powered by water that is circulated by a pump that is installed at the pool. These cleaners clean the bottom and side walls of the pool below water level to a greater or lesser extent. Suction type pool bottom cleaners are connected at the pool weir but their effectiveness is steadily reduced as debris is accumulated in the leaf basket that is located in the weir.

Pool surface skimmers have been independently developed and are intended to draw floating debris off the surface of the pool water, to the extent this is achieved it reduces the amount of cleaning of the pool floor that is required. Again the skimmers work to a greater or lesser extent, most commonly the skimming function is linked to the pool weir, see for example U.S. Pat. No. 5,490,923 to Penney. The effectiveness of weir based skimmers is, however, much reduced by the connection of the pipe that leads to suction type automated pool bottom cleaners in the weir. Skimmers that are connected at the return nozzle for circulating water have disadvantages: the type that collects debris in a sock tends to burst the sock if not cleared timeously, other types tend to snap off where they are attached to the pool.

THE INVENTION

A pool cleaning installation in accordance with this invention includes a pump, filtering means, weir and connection means for an automated suction type pool bottom and side walls cleaner, connected for circulating pool water, is characterized in that it provides a connection for the circulating water from the automated cleaner to the filtering means and pump and in that the weir has a Venturi and a return pipe in it, to which Venturi the installation provides a return of the circulating water from the filtering means and pump, the Venturi acting to draw water from the weir to the return pipe to the pool.

As the water is drawn from the weir to the return pipe the floating debris will be skimmed from the water surface. The weir may advantageously have a debris trap like a leaf basket in it to collect debris skimmed off the water surface but one of the benefits of the invention is that if the trap is allowed to become clogged the power of the circulating water that drives the automated cleaner is not affected at all.

The return pipe may have a deflector means to allow the direction and kinetic energy of the return flow of water into the pool to be directed in a selected direction. For example the return flow into the pool may be directed upward, downward, to left or to right.

The filtering means may comprise a debris trap and a sand filter, conveniently located in most installations upstream of the pump.

The weir may have a one-way flap that allows water and debris in but stops debris going out.

This installation thus circulates the water in the opposite direction to the well established system, where the water is drawn from the weir and returned to the pool by a nozzle directly into the pool.

It is preferred that that the weir has an offset entrance so as to cause a whirlpool or vortex effect as this helps to draw the surface debris downwards into the leaf trap; for this purpose too the weir preferably has a plate that has a hole at its centre above the leaf trap to assist in keeping the surface debris in the leaf trap once they are in there.

THE DRAWINGS

The invention is more fully described by way of example with reference to the drawings, in which:—

THE PREFERRED EMBODIMENTS

Figure 1:
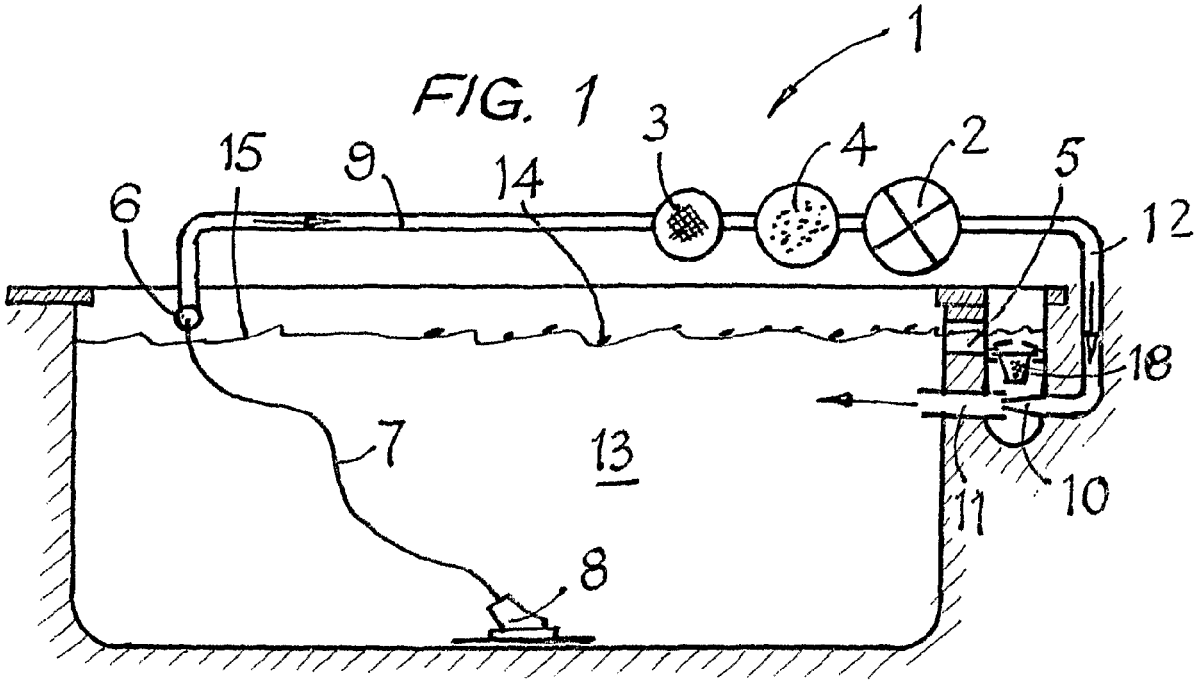
FIG. 1 is a schematic cross-sectional elevation of a pool installation.
Figure 2:
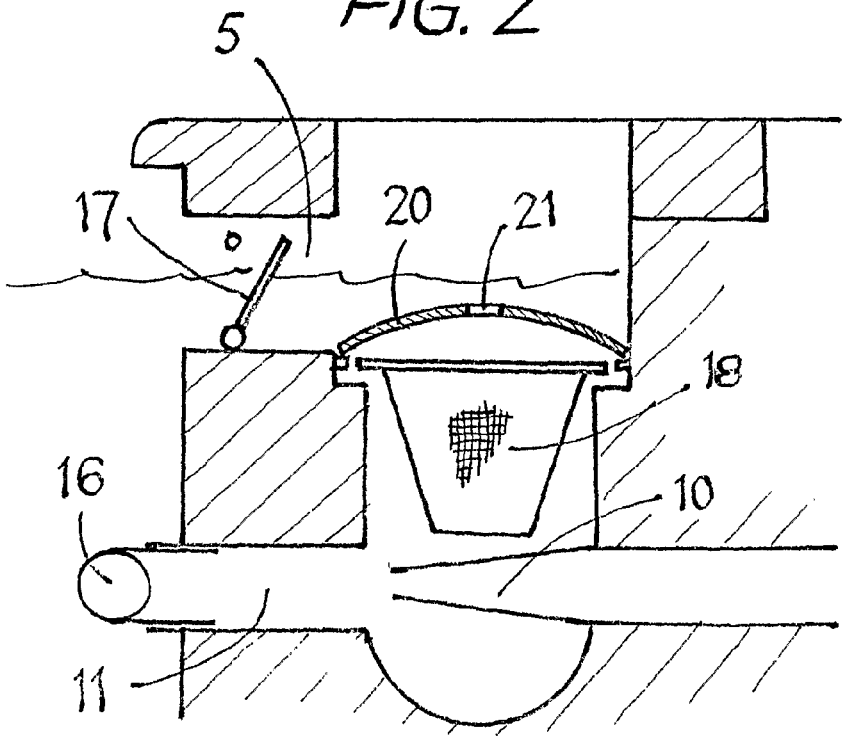
FIG. 2 is a schematic cross sectional elevation of the weir assembly of the installation.

As shown in FIGS. 1 and 2 the pool cleaning installation 1 includes a pump 2, filtering means 3, 4, weir 5 and connection means 6 for a flexible pipe 7 of an automated suction type pool bottom and side walls cleaner 8, connected for circulating pool water. The installation has a connection 9 for the circulating water from the automated cleaner to the filtering means and pump and the weir has a Venturi 10 and a return pipe 11 in it, to which Venturi pipes 12 of the installation provides a return of the circulating water from the filtering means and pump. The Venturi acts to draw water from the weir to the return pipe to the pool 13. The filtering means is a leaf trap 3 and a sand filter 4 for example, other filters as are available may be used.

As the water is drawn from the weir to the return pipe the floating debris 14 will be skimmed from the water surface 15. The weir has a leaf basket 18 in it to collect debris skimmed off the water surface.

The return pipe has a deflector means 16 that may be rotated to allow the direction of the return flow of water into the pool to be directed in a selected direction.

The weir has a one-way flap 17 that allows water and debris in but stops debris going out.

Figure 3:
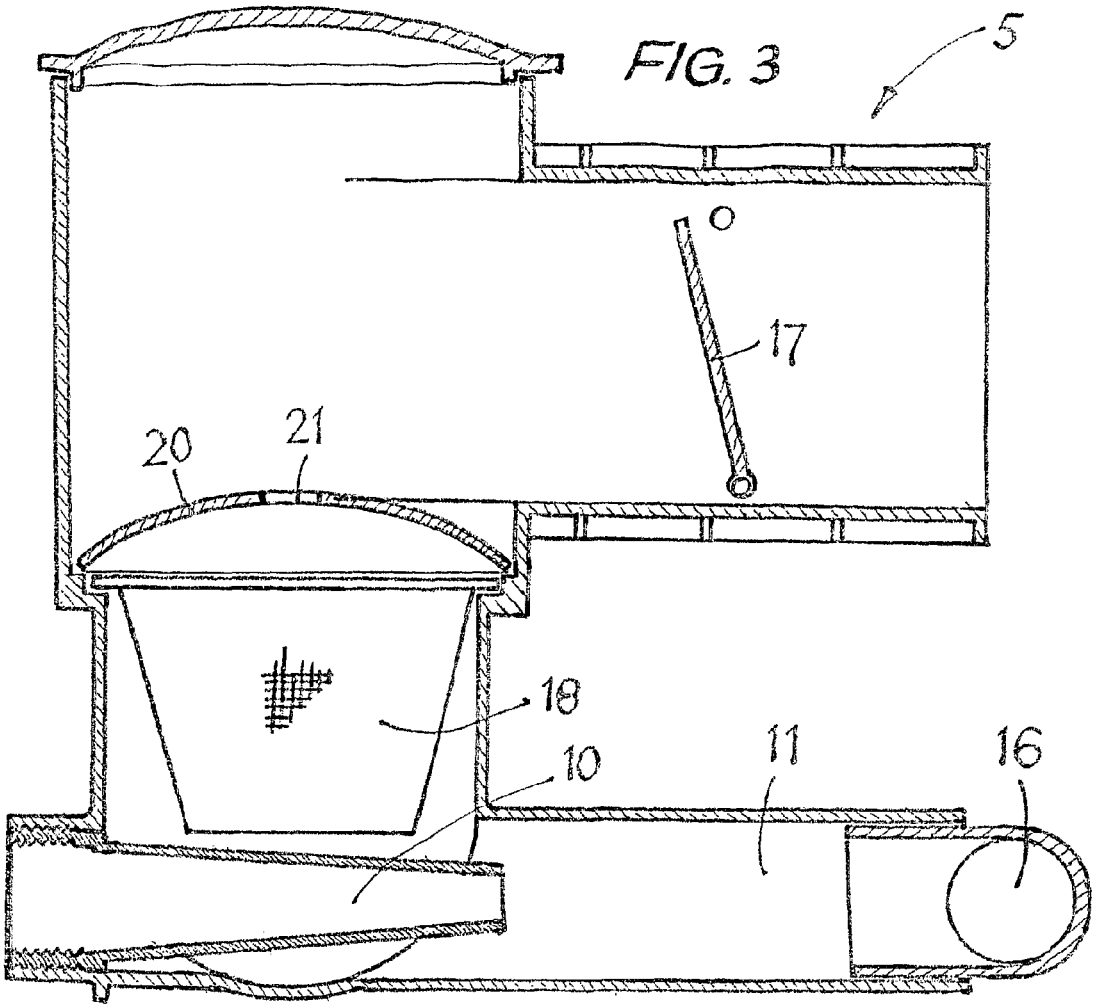
FIG. 3 is a cross sectional elevation of a preferred embodiment of the weir.
Figure 4:
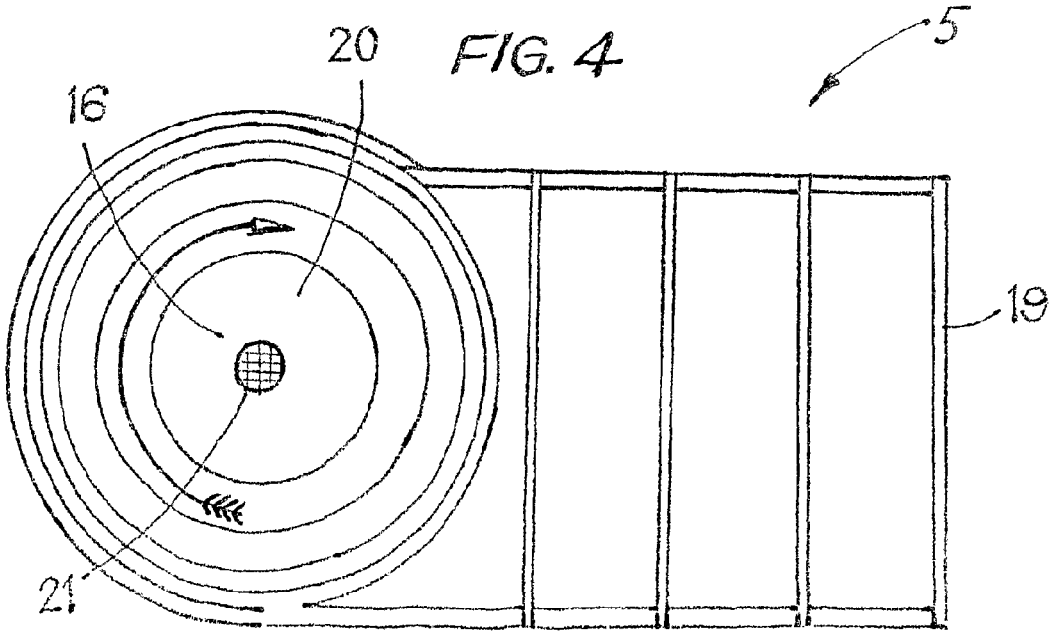
FIG. 4 is a plan view of the weir.

The weir is shown in greater detail in FIGS. 3 and 4 and the same reference numerals are used for the same parts and the description above is referred to.

As seen in the view of FIG. 4 the entrance 19 to the weir is offset so as to cause a vortex as indicated by the arrow in that view. A plate 20 is positioned above the leaf trap with a hole 21 for passage of water and surface debris into the leaf trap.

REFERENCE NUMERALS

1 pool cleaning installation
2 pump
3 leaf trap
4 sand filter
5 weir
6 suction connection
7 flexible pipe of automated pool cleaner
8 automated pool cleaner
9 pipe
10 Venturi
11 return pipe to pool
12 pipe
13 pool
14 surface debris

15 water surface
16 deflector for return water
17 one-way flap in weir
18 leaf basket.
19 weir entrance
20 plate
21 hole in plate

The invention claimed is:

1. A pool cleaning installation which includes a pump, filtering means, weir and connection means for an automated suction type pool cleaner, connected for circulating pool water, wherein the installation provides a suction connection for the circulating water from the automated cleaner to the filtering means and pump and the weir has a Venturi and a return pipe in it, to which Venturi the installation provides a return of the circulating water from the filtering means and pump, the Venturi acting to draw water from the weir to the return pipe into the pool, and wherein the pool side opening of the weir includes an entrance configured to allow water from the pool to flow into the remainder of the weir, wherein the entrance is horizontally offset relative to the center of the remainder of the weir.

2. A pool cleaning installation as claimed in claim 1, wherein the weir has a debris trap in it to collect debris skimmed off the water surface.

3. A pool cleaning installation as claimed in claim 2, wherein the weir includes a cover positioned over the debris trap, wherein the cover is configured to assist in preventing surface debris that has entered the debris trap from returning to the pool.

4. A pool cleaning installation as claimed in claim 3, wherein the cover includes a hole in the center of the plate.

5. A pool cleaning installation as claimed in claim 1, wherein the return pipe has a deflector means to allow the direction of the return flow of water into the pool to be directed in a selected direction.

6. A pool cleaning installation as claimed in claim 5, wherein the deflector means allows the direction and kinetic energy of a return flow of the water into the pool to be directed upward, downward, to the left or to the right.

7. A pool cleaning installation as claimed in claim 1, wherein the filtering means comprises a debris trap and a sand filter, located upstream of the pump.

8. A pool cleaning installation as claimed in claim 1, wherein the weir has a one-way flap that allows water and debris in but stops debris going out.

9. The pool cleaning installation of claim 1, wherein the horizontally offset positioning of the entrance of the weir relative to the center of the remainder of the weir causes a whirlpool or vortex effect to draw surface debris downwards into the remainder of the weir.

10. A pool cleaning installation as claimed in claim 1, wherein the return pipe is wider than a nozzle of the Venturi which directs water into the return pipe.

11. A pool cleaning installation as claimed in claim 1, wherein the return pipe does not restrict the return of the circulating water into the pool.

12. A pool cleaning installation which includes a pump, filtering means, weir and connection means for an automated suction type pool cleaner, connected for circulating pool water, wherein the installation provides a suction connection for the circulating water from the automated cleaner to the filtering means and pump and the weir has a Venturi and a return pipe in it, to which Venturi the installation provides a return of the circulating water from the filtering means and pump, the Venturi acting to draw water from the weir to the return pipe into the pool, wherein the weir includes an entrance configured to allow water from the pool to flow into the remainder of the weir, wherein the entrance is horizontally offset relative to the center of the remainder of the weir.

13. The pool cleaning installation of claim 12, wherein the horizontally offset positioning of the entrance of the weir relative to the center of the remainder of the weir causes a whirlpool or vortex effect to draw surface debris downwards into the remainder of the weir.

14. A pool cleaning installation comprising:

a pump;

a filtering means;

a weir a Venturi;

a return pipe;

an automated suction type pool bottom and sides cleaner; and a connection means for connecting the automated suction type pool bottom and sides cleaner to the filtering means, pump and the weir, wherein the automated suction type pool bottom and sides cleaner circulates pool water through the connection means, wherein the pool installation provides a suction connection for the circulating water from the automated suction type pool bottom and sides cleaner to the filtering means and the pump, wherein the weir at least partially houses the Venturi and the return pipe and the installation provides a return of the circulating water from the filtering means and pump to the Venturi and the Venturi acts to draw water from the weir to the return pipe into the pool, wherein the connection means does not engage a pool side opening of the weir, and wherein the pool side opening of the weir includes an entrance configured to allow water from the pool to flow into the remainder of the weir, wherein the entrance is horizontally offset relative to the center of the remainder of the weir.

15. The pool cleaning installation of claim 14, wherein the filtering means comprises a debris trap and a sand filter located upstream of the pump, wherein the pump is located upstream of the weir.

16. The pool cleaning installation of claim 14, wherein the connection means comprises:

a flexible pipe engaged with the automated suction type pool bottom and sides cleaner; and a connection connecting the flexible pipe with the filtering means.

17. The pool cleaning installation of claim 14, wherein the horizontally offset positioning of the entrance of the weir relative to the center of the remainder of the weir causes a whirlpool or vortex effect to draw surface debris downwards into the remainder of the weir.

* * * * *